US009238855B2

(12) United States Patent
Sakamoto et al.

(10) Patent No.: US 9,238,855 B2
(45) Date of Patent: Jan. 19, 2016

(54) FERRITE-BASED STAINLESS STEEL FOR USE IN COMPONENTS OF AUTOMOBILE EXHAUST SYSTEM

(75) Inventors: Shunji Sakamoto, Kitakyushu (JP); Shinichi Teraoka, Kitakyushu (JP); Nobuhiko Hiraide, Shunan (JP)

(73) Assignee: NIPPON STEEL & SUMIKIN STAINLESS STEEL CORPORATION, Tokyo (JP)

( * ) Notice: Subject to any disclaimer, the term of this patent is extended or adjusted under 35 U.S.C. 154(b) by 187 days.

(21) Appl. No.: 13/634,593

(22) PCT Filed: Mar. 9, 2011

(86) PCT No.: PCT/JP2011/055513

§ 371 (c)(1), (2), (4) Date: Sep. 13, 2012

(87) PCT Pub. No.: WO2011/114964

PCT Pub. Date: Sep. 22, 2011

(65) Prior Publication Data

US 2013/0004361 A1 Jan. 3, 2013

(30) Foreign Application Priority Data

Mar. 15, 2010 (JP) ..... 2010-057865

(51) Int. Cl.

| | |
|---|---|
| ***C22C 38/48*** | (2006.01) |
| ***C22C 38/50*** | (2006.01) |
| ***C22C 38/02*** | (2006.01) |
| ***C22C 38/00*** | (2006.01) |
| ***C22C 38/04*** | (2006.01) |
| ***C22C 38/06*** | (2006.01) |
| ***C22C 38/40*** | (2006.01) |
| ***C21D 6/00*** | (2006.01) |

(52) U.S. Cl.

CPC ..... *C22C 38/02* (2013.01); *C21D 6/002* (2013.01); *C22C 38/001* (2013.01); *C22C 38/004* (2013.01); *C22C 38/008* (2013.01); *C22C 38/04* (2013.01); *C22C 38/06* (2013.01); *C22C 38/40* (2013.01); *C22C 38/48* (2013.01); *C22C 38/50* (2013.01); *F01N 2530/04* (2013.01)

(58) Field of Classification Search

None

See application file for complete search history.

(56) References Cited

FOREIGN PATENT DOCUMENTS

| | | |
|---|---|---|
| CN | 101437974 | 5/2009 |
| JP | 60-046352 | 3/1985 |
| JP | 64-004576 | 1/1989 |
| JP | 04-235256 | 8/1992 |
| JP | 06-145906 | 5/1994 |
| JP | 2756190 | 5/1998 |
| JP | 11-092872 | 4/1999 |

(Continued)

OTHER PUBLICATIONS

Machine-English translation of Japanese patent No. 2010-031315, Hiraide Nobuhiko et al., Feb. 12, 2010.*

(Continued)

*Primary Examiner* — Deborah Yee

(74) *Attorney, Agent, or Firm* — Kenyon & Kenyon LLP.

(57) ABSTRACT

This ferritic stainless steel for components of an automobile exhaust system includes, in terms of percent by mass: C: ≤0.015%; Si: 0.01% to 0.50%; Mn: 0.01% to 0.50%; P: ≤0.050%; S: ≤0.010%; N: ≤0.015%; Al: 0.010% to 0.100%; Cr: 16.5% to 22.5%; Ni: 0.5% to 2.0%; and Sn: 0.01% to 0.50%, and further includes either one or both of Ti: 0.03% to 0.30% and Nb: 0.03% to 0.30%, with a remainder being Fe and inevitable impurities.

2 Claims, 2 Drawing Sheets

(a)

(b)

(56) References Cited

FOREIGN PATENT DOCUMENTS

| | | |
|---|---|---|
| JP | 2001-288543 | 10/2001 |
| JP | 2002-038221 | 2/2002 |
| JP | 2005-146345 | 6/2005 |
| JP | 2006-118011 | 5/2006 |
| JP | 2007-092163 | 4/2007 |
| JP | 2008-144204 | 6/2008 |
| JP | 2008-190003 | 8/2008 |
| JP | 2009-097079 | 5/2009 |
| JP | 2009-174036 | 8/2009 |
| JP | 2010-031315 | 2/2010 |

OTHER PUBLICATIONS

Machine-English translation of Japanese patent No. 2008-190003, Hiraide Nobuhiko et al., Aug. 21, 2008.*

International Search Report dated May 17, 2011, issued in corresponding PCT Application No. PCT/JP2011/055513.

Office Action dated Mar. 3, 2014 issued in corresponding Chinese Application No. CN 201180013600.6 [with English Translation].

* cited by examiner (a)

(b)

FERRITE-BASED STAINLESS STEEL FOR USE IN COMPONENTS OF AUTOMOBILE EXHAUST SYSTEM

TECHNICAL FIELD

The present invention relates to a lean alloy type (composition having low contents of alloying elements) ferrite-based stainless steel (ferritic stainless steel) that is excellent in corrosion resistance after being heated and can be preferably used in components of an automobile exhaust system. The present invention particularly relates to a ferritic stainless steel material which is appropriate for components that are exposed to environments of relative mild temperature conditions such as center pipes, mufflers, tail pipes, and the like, and can sufficiently secure corrosion resistance after being heated while containing no Mo or containing an amount of Mo as low as possible, which is an expensive alloying element.

This application is a national stage application of International Application No. PCT/JP2011/055513, filed Mar. 9, 2011, which claims priority to Japanese Patent Application No. 2010-057865 filed on Mar. 15, 2010, the content of which is incorporated herein by reference.

BACKGROUND ART

Ferritic stainless steel sheets and steel pipes have been frequently used in components of exhaust systems. For example, SUH409L is a steel that contains 11% of Cr, in which C and N are fixed by Ti so as to prevent sensitization of welded portions and to attain excellent workability. SUH409 has sufficient high-temperature characteristics at 700° C. or lower, and in addition, SUH409 exhibits a certain degree of resistance to condensed water corrosion; and therefore, SUH409L is most frequently used. In addition, steels are also used which have enhanced resistance to condensed water corrosion and resistance to salt corrosion, such as AISI439 which contains 17% of Cr and in which C and N are fixed by Ti, SUS436J1L and SUS436L which further contain Mo, and the like.

Meanwhile, due to diversification of fuels such as bio-fuels and the like, or regulations for improving gas mileages in recent years, corrosion environments for materials for an automobile exhaust system are changing. In addition, in emerging markets, a decrease in the pH of exhaust gas-condensed water generated from poor fuels is becoming a problem. In consideration of such situations, it has come to be considered that a higher level of corrosion resistance is required. In response to the above, SUS436L and the like which contain Mo so as to enhance the corrosion resistance are regarded as being appropriate for materials for exhaust systems in the related art. However, in a situation of the current steep rise in resource prices, Mo is known as one of the most expensive alloying elements, and there has been a long desire for a new type of steel which contains no Mo or contains an amount of Mo as low as possible, and exhibits corrosion resistance similar to or superior to that of SUS436.

Regarding the above problems, several techniques have been proposed in the related art.

For example, Patent Document 1 discloses a steel that contains both of Cu: 0.3% to 2.0% and P: 0.06% to 0.5% instead of containing Mo so as to secure corrosion resistance similar to or superior to that of a 17Cr-1Mo steel. However, since both of Cu and P are solid solution strengthening elements, deterioration of the workability is inevitably caused when a large amount of Cu and P are included. Workability as well as corrosion resistance is also an indispensable property for materials that are applied to components in exhaust systems; and therefore, it is difficult to apply the above-described steel to the components in exhaust systems.

Patent Document 2 discloses a steel that contains both of Cu: 0.5% to 2.0% and V: 0.05% to 2.0% instead of containing Mo so as to secure corrosion resistance similar to or superior to that of a 17Cr-0.5Mo steel. However, similarly to the case of Patent Document 1, since Cu is a solid solution strengthening element, deterioration of the workability is inevitably caused when a large amount of Cu is included. In addition, similarly to Mo, V has a problem of being an expensive alloying element.

Patent Document 3 discloses a steel in which the amount of Si is reduced in order to secure workability, and 0.01% to 1.0% of Co is included in order to improve the corrosion resistance without impairing the workability, and in the steel, corrosion resistance similar to that of 18Cr—Mo steel is secured. However, a small content, approximately 0.05%, of Co is sufficient only in the case where approximately 25% of Cr is included. The content of Co needs to be approximately 0.5% in the case where approximately 18% of Cr is included. In addition, similarly to Mo, Co also has a problem of being an expensive and rare alloying element.

Patent Document 4 discloses a steel in which either one or both of Ni: 0.1% to 2.0% and Cu: 0.1% to 1.0% are included at a total amount of 0.6% or more so as to enhance the corrosion resistance without including Mo. However, in order to obtain corrosion resistance superior to that of SUS436L, it is necessary to include large amounts of alloying elements, such as a steel containing 20% of Cr and 1% of Ni. Therefore, there is a problem in that the above-described technique does not necessarily reduce the costs. In addition, Cu is an element that strengthens a steel more than Mo, and there is a problem in that the workability deteriorates even at a small content of Cu.

Meanwhile, as an interesting technique that is approximately consistent with the purport of the present invention, which is a lean alloy (composition having low contents of alloying elements), a technique has been disclosed in which a steel contains extremely small amounts of Sn and Sb, which are alloying elements and gained little attention in the related art, so as to improve the characteristics of the steel.

For example, Patent Document 5 discloses a ferritic stainless steel which contains 0.02% to 0.2% of Sb so as to improve the oxidation resistance. Patent Document 6 discloses a ferritic stainless steel sheet which contains either one or both of Sn and Sb at a content of 0.005% to 0.10% so as to prevent intergranular corrosion of P. Thereby, there does not occur surface scratches which are caused by intergranular corrosion when the steel sheet is pickled using sulfuric acid. In addition, Patent Document 7 discloses that it is effective to include 0.5% or less of Sn for suppressing intergranular corrosion that is caused by Cr carbonitrides in welded heat-affected zones.

However, in the above-described techniques, there is no description regarding the resistance to salt corrosion and the resistance to condensed water corrosion after heating of components in exhaust systems, which will be dealt with in the present invention.

Meanwhile, in recent years, attention has been paid to an effect of Sn and Sb for improving corrosion resistance so as to develop a new type of steel.

For example, Patent Document 8 discloses a ferritic stainless steel sheet that contains either one or both of Sn and Sb, and is excellent in crevice corrosion resistance. In addition, Patent Document 9 also discloses a ferritic stainless steel that contains Sn and Sb as selective elements in order to suppress flow of rusting from crevice portions.

All of the above-described techniques deal with crevice corrosion. In the ferritic stainless steel, it is necessary to include proper contents of alloying elements in order to suppress the crevice corrosion. Therefore, in these techniques, the contents of the alloying elements are generally large; and thereby, characteristics other than the corrosion resistance (for example, workability and costs) do not necessarily fulfill the satisfactory levels. Therefore, there is a possibility of better optimization.

PRIOR ART DOCUMENT

Patent Document

Patent Document 1: Japanese Unexamined Patent Application, First Publication No. H6-145906

Patent Document 2: Japanese Examined Patent Application, Second Publication No. S64-4576

Patent Document 3: Japanese Patent Granted Publication No. 2756190

Patent Document 4: Japanese Unexamined Patent Application, First Publication No. 2007-92163

Patent Document 5: Japanese Unexamined Patent Application, First Publication No. 2005-146345

Patent Document 6: Japanese Unexamined Patent Application, First Publication No. H11-92872

Patent Document 7: Japanese Unexamined Patent Application, First Publication No. 2002-38221

Patent Document 8: Japanese Unexamined Patent Application, First Publication No. 2008-190003

Patent Document 9: Japanese Unexamined Patent Application, First Publication No. 2009-97079

DISCLOSURE OF THE INVENTION

Problems to be Solved by the Invention

The present invention aims to provide a steel that contains no Mo or a reduced amount of Mo, and has corrosion resistance and workability similar to or superior to those of (17Cr-1.2Mo-based) SUS436L.

Meanwhile, the corrosion resistance dealt with in the present invention refers to resistance to condensed water corrosion and resistance to salt corrosion in general planar portions required in components in exhaust systems that are used in a relative low temperature range, such as mufflers and the like. Particularly, the present invention deals with the corrosion resistance after a material is heated so as to form an oxide film, that is, a characteristic of perforation corrosion which determines the service lives of components in exhaust systems. Meanwhile, in the present invention, the heating environment is assumed to be an atmosphere at 400° C. In addition, corrosion resistance after the material is maintained for 8 hours, which is a sufficient time to form an oxide film in the heating environment, will be considered.

Means for Solving the Problems

The present inventors carried out a large number of salt corrosion tests and condensed water corrosion tests on a variety of stainless steel materials. As a result, it was found that corrosion resistance after heating is greatly improved by adding an appropriate amount of both of Sn and Ni, and this effect is stronger than the effect of Mo.

The present invention is based on the above finding, and the features are shown as below.

(1) A ferritic stainless steel for components of an automobile exhaust system according to an aspect of the present invention includes, in terms of percent by mass: C:≤0.015%; Si: 0.01% to 0.50%; Mn: 0.01% to 0.50%; P: ≤0.050%; S: ≤0.010%; N: ≤0.015%; Al: 0.010% to 0.100%; Cr: 16.5% to 22.5%; Ni: 0.5% to 2.0%; and Sn: 0.01% to 0.50%, and further includes either one or both of Ti: 0.03% to 0.30% and Nb: 0.03% to 0.30%, with a remainder being Fe and inevitable impurities.

(2) The ferritic stainless steel for components of an automobile exhaust system according to the above (1) may further includes, in terms of percent by mass, B: 0.0002% to 0.0050%.

(3) The ferritic stainless steel for components of an automobile exhaust system according to the above (1) or (2) may further includes, in terms of percent by mass, either one or both of Mo: 0.01% to 0.50% and Cu: 0.01% to 0.35%.

Effects of the Invention

According to the aspect of the present invention, it is possible to provide a steel that contains no Mo or a reduced amount of Mo, and has corrosion resistance after heating and workability similar to or superior to those of SUS436L. Therefore, the industrial effects are great.

BEST MODE FOR CARRYING OUT THE INVENTION

The inventors investigated resistance to salt corrosion and resistance to condensed water corrosion after a heating treatment of 400° C.×8 Hr using steel sheets in which the content of Cr, that controls corrosion resistance, was fixed to 17%, and the contents of Mo, Sn, and Ni were varied, and steel sheets containing both of Sn and Ni.

The resistance to salt corrosion was evaluated through the combined cycle corrosion test defined in JASO-M609-91. Here, in the combined cycle corrosion test, spraying of salt water, drying, and moistening were carried out repeatedly. During the spraying of salt water, a solution of 5% NaCl was sprayed to specimens at 35° C. for 2 hours. During the drying, the specimens were left to stand in an atmosphere having a relative humidity of 20% at 60° C. for 4 hours. During the moistening, the specimens were left to stand in an atmosphere having a relative humidity of 90% at 50° C. for 2 hours.

The resistance to condensed water corrosion was evaluated through a condensed water corrosion test based on JASO-M611-92-A. Here, the conditions of the condensed water corrosion test differ from those of JASO standards in that the concentration of Cl ions in the corrosion fluid was changed to 1000 ppm.

Figure 1:
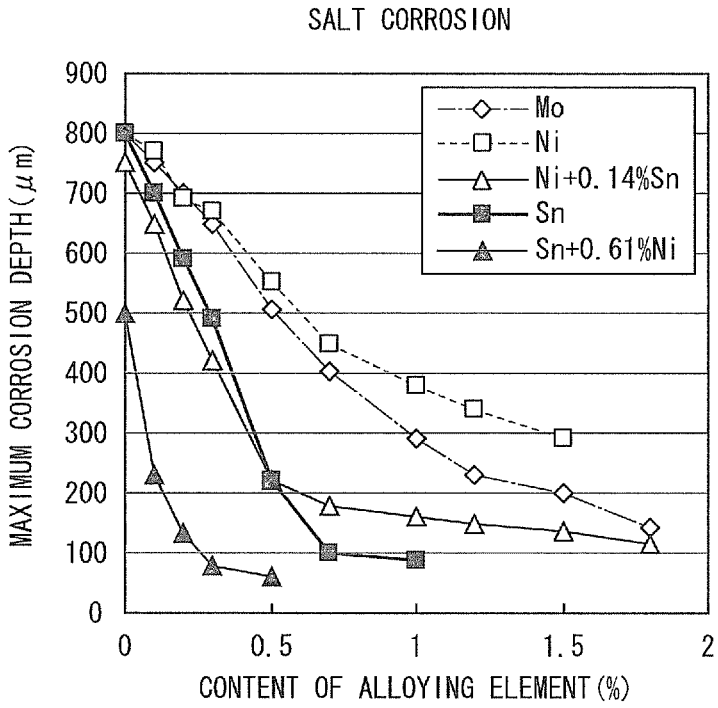
FIG. 1 is a view showing the influences of Mo, Sn, and Ni which affect corrosion resistance after heating, in which FIG. (*a*) is a view showing resistance to salt corrosion, and FIG. (*b*) is a view showing resistance to condensed water corrosion.
Figure 1:
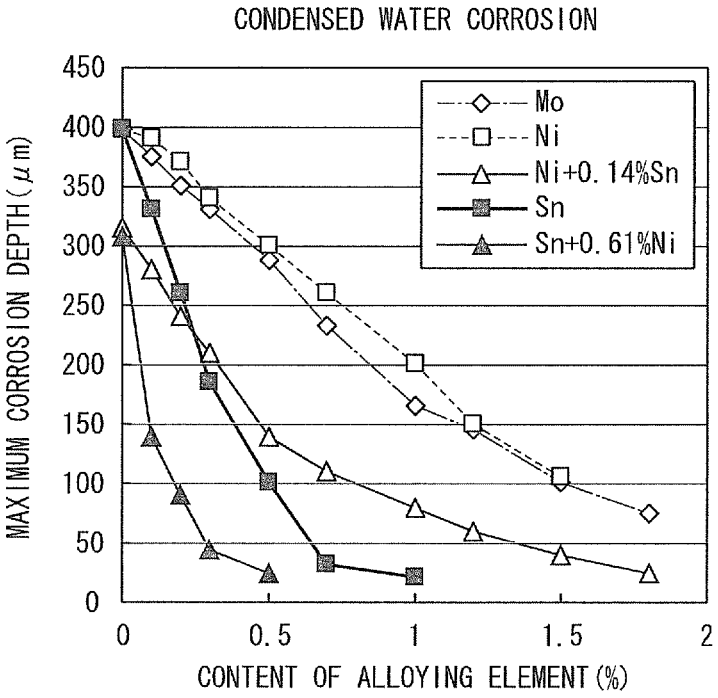

An example of the results is shown in FIG. 1. FIG. 1 is a view showing the relationships between the content of an alloying element and the maximum corrosion depth, in which FIG. (*a*) shows the results of salt corrosion and FIG. (*b*) shows the results of condensed water corrosion. The content of the alloying element as shown along the horizontal axis in FIG. 1 refers to the respective content of Mo, Ni, and Sn as described in the caption (description of reference signals) in FIG. 1. "Ni+0.14% Sn" in the caption indicates that the content of Sn is fixed to 0.14%, and the content of Ni is varied as shown in the horizontal axis in FIG. 1. Similarly, "Sn+0.61% Ni" indicates that the content of Ni is fixed to 0.61%, and the content of Sn is varied as shown in the horizontal axis in FIG. 1.

It is evident from FIG. 1 that all of Mo, Sn, and Ni improve corrosion resistance. Particularly, it was found that Sn is an element that develops an effect of improving corrosion resistance approximately 2.5 times more than Mo. In addition, it was found that Ni is an element that develops an effect of improving corrosion resistance as much as Mo. As such, it can be understood that Ni or Sn alone can replace Mo; however, it was found that the effect becomes stronger in the case where both of Ni and Sn are included. Particularly, in the case where Ni is included together with a small amount, approximately 0.1%, of Sn, the content of Ni can be reduced to approximately ⅔ of the content of Ni in the case where Ni alone is included. Since both of Ni and Sn are solid solution strengthening elements which deteriorate workability, the effect of reducing the content of Ni by adding a small amount of Sn produces merits not only for resource saving and reduction of alloy costs but also for workability. As such, a steel in which both of Sn and Ni were added could be evaluated to be a type of a steel having sufficient properties for replacing a Mo-containing steel.

A mechanism of developing such an effect due to the co-presence of Sn and Ni is not clarified yet. However, both of Sn and Ni presumably exhibit actions of suppressing active dissolution and promoting re-passivation in a corrosion progress step, because both of Sn and Ni are elements having no effect in a corrosion occurrence step. In addition, it is also assumed that Sn and Ni contribute to an action of densifying an oxide film that is formed through a heating treatment. These actions are not useful for a problem of occurrence of rust such as initial rust; however, these actions are useful for improving perforation service life. Therefore, the above-described actions can be optimal ways of improvement for components in exhaust systems for which the service life is more important than the appearance.

Figure 2:
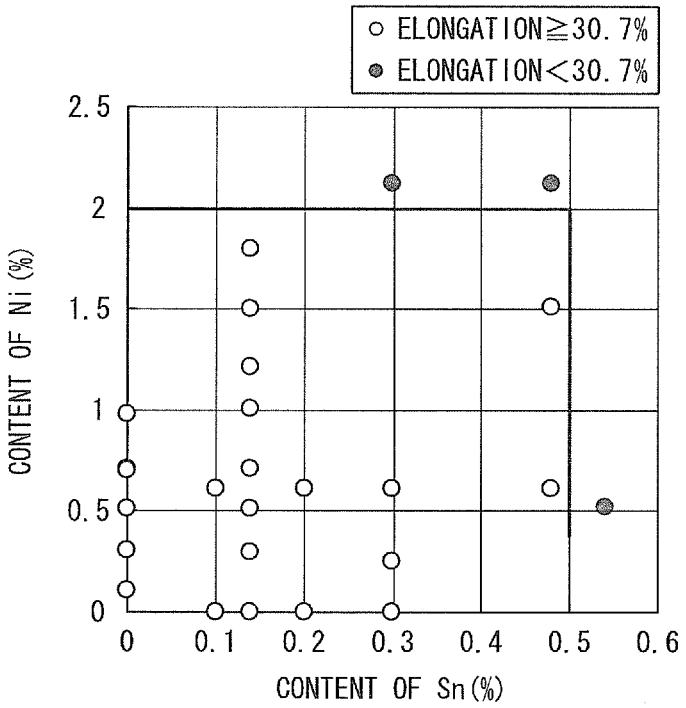
FIG. 2 is a view showing appropriate ranges for the contents of Sn and Ni in order to secure workability similar to that of SUS436L.

Next, for materials that were used in the investigation of corrosion resistance, workability was also investigated. A No. 13B test specimen in JIS Z2201 was manufactured, and a tensile test was carried out using the test specimen so as to measure the total elongation. The workability was evaluated using the measured value of the total elongation. The obtained results are shown in FIG. 2. FIG. 2 shows the ranges of the contents of Sn and Ni in which similar workability can be secured when the elongation value (30.7%) of SUS436L is used as a comparison standard. Based on the above, it was found that the upper limit of the content of Sn is preferably set to 0.5%, and the upper limit of the content of Ni is preferably set to 2.0%.

From the above, in the case where an appropriate amount of both of Sn and Ni is added to a steel, the steel can be evaluated as being available for actual use as a material for exhaust systems which replaces SUS436L.

Meanwhile, a small amount of Mo and Cu may be included in order to further improve the corrosion resistance while such inclusion is contrary to the purpose of a lean alloy. However, the effect of Mo and Cu for improving the corrosion resistance is smaller than the effect of the co-presence of Sn and Ni (the effect that can be obtained when Sn and Ni are present together). Therefore, Mo and Cu are not preferentially included rather than Sn and Ni. In addition, it is necessary to consider that inclusion of Mo and Cu not only increases the alloy costs, but also deteriorates the workability or manufacturability. The upper limit of the content of Cu is preferably set to 0.35%, and the upper limit of the content of Mo is preferably set to 0.50%.

Hereinafter, the actions of the alloying elements in the embodiment and reasons why the contents thereof are limited will be described in detail.

C, N: C and N are elements that cause intergranular corrosion in welded heat-affected zones, and C and N deteriorate the corrosion resistance after heating. In addition, C and N deteriorate cold workability. Therefore, the contents of C and N should be suppressed to a level as low as possible, and each of the upper limits of the contents of C and N is preferably 0.015%, and more preferably 0.010%.

Si: Si has an action of improving the corrosion resistance after heating; and therefore, 0.01% or more of Si is included. However, since Si deteriorates the workability, a large amount of Si should not be included, and the upper limit of the content of Si is preferably limited to 0.50%. The content of Si is preferably in a range of 0.05% to 0.30%.

Mn: Mn also has an action of improving the corrosion resistance after heating; and therefore, 0.01% or more of Mn is included. However, since Mn deteriorates the workability, a large amount of Mn should not be included, and the upper limit of the content of Mn is preferably limited to 0.50%. The content of Mn is preferably in a range of 0.05% to 0.30%.

P: P is an element that deteriorates the workability. Therefore, the content of P is desirably limited to a level as low as possible. The permissible upper limit of the content of P is set to 0.050%. The upper limit of the content of P is preferably 0.030%.

S: S is an element that deteriorates the corrosion resistance after heating. Therefore, the content of S is desirably limited to a level as low as possible. The permissible upper limit of the content of S is set to 0.010%. The upper limit of the content of S is preferably 0.0050%, and more preferably 0.0030%.

Cr: Cr is a basic element for securing the corrosion resistance after heating, and it is essential to include an appropriate amount of Cr. It is necessary to set the lower limit of the content of Cr to 16.5%. Meanwhile, the upper limit of the content of Cr is preferably set to 22.5% from the viewpoints of the fact that Cr is an element that deteriorates the workability and the need to suppress alloy costs. The content of Cr is preferably in a range of 16.8% to 19.5%.

Al: Al is useful as a deoxidizing element, and Al has an action of improving the corrosion resistance after heating. Therefore, 0.010% or more of Al is included. However, since Al deteriorates the workability, a large amount of Al should not be included. The upper limit of the content of Al is preferably limited to 0.100%. The content of Al is preferably in a range of 0.020% to 0.060%.

In the embodiment, either one or both of Ti and Nb are included.

Ti: Ti has an action of fixing C and N in the form of carbonitrides so as to suppress intergranular corrosion. Therefore, in the case where Ti is included, the lower limit of the content of Ti is set to 0.03%. However, since the effect becomes saturated, and the workability is impaired even when an excessive amount of Ti is included, the upper limit of the content of Ti is set to 0.30%. The upper limit of the content of Ti is preferably 0.20%. Meanwhile, the content of Ti is preferably in a range of 5 times or more to 30 times or less of the sum of the contents of C and N.

Nb: Similarly to Ti, Nb has an action of fixing C and N in the form of carbonitrides so as to suppress intergranular corrosion. Therefore, in the case where Nb is included, the lower limit of the content of Nb is set to 0.03%. However, since the workability is impaired even when an excessive amount of Nb is included, the upper limit of the content of Nb is set to 0.30%. The content of Nb is preferably in a range of 0.03% to 0.10%.

Sn: Sn is extremely useful as an element that greatly improves the corrosion resistance after heating even when the content is low, and Sn is an alloying element that serves as a basis of the stainless steel of the embodiment. The lower limit of the content of Sn is set to 0.01%. The lower limit of the content of Sn is preferably 0.05%. On the other hand, Sn is an element that impairs the workability, and Sn also impairs the toughness of welded portions. Therefore, it is not desirable that more than 0.5% of Sn is included. The upper limit of the content of Sn is preferably 0.4%, and more preferably 0.3%.

Ni: In the case where both of Ni and Sn are added, the corrosion resistance after heating is greatly improved even when the content of Ni is relatively small. Ni is an extremely useful element, and Ni is an alloying element that serves as a basis of the stainless steel of the embodiment. The lower limit of the content of Ni is 0.5%. Meanwhile, in the case where the content of Ni becomes excessive, a martensite structure appears and hardens. Therefore, the upper limit of the content of Ni is set to 2.0%. The upper limit of the content of Ni is preferably 1.5%, and more preferably 1.0%.

The stainless steel in the embodiment may contain the following optional elements according to necessity.

B: B is a useful element that suppresses the intergranular corrosion of Sn so as to prevent secondary work embrittlement caused by degradation of grain boundary strength or deterioration of hot workability. B is an element that has no influence on the corrosion resistance after heating. Therefore, B may be included according to necessity, and the lower limit of the content of B is set to 0.0002%. In the case where the content of B exceeds 0.0050%, the hot workability inversely deteriorates; and therefore, the upper limit of the content of B is preferably set to 0.0050%. The content of B is preferably in a range of 0.0004% to 0.0015%.

Mo: In the case where ultimate corrosion resistance after heating is pursued, a small amount of Mo may be included while such inclusion is contrary to the definition of a lean alloy (reduction of the contents of alloying elements) and low costs. In the case where Mo is included, the lower limit of the content of Mo is set to 0.01%. Thereby, it becomes easier to surpass the corrosion resistance of SUS436L after heating. In addition, since it is necessary to maintain the content of Mo at a requisite minimum level in a range in which workability does not deteriorate, the upper limit of the content of Mo is set to 0.50%. The upper limit of the content of Mo is preferably 0.3%, and more preferably 0.2%.

Cu: Similarly to Mo, in the case where ultimate corrosion resistance after heating is pursued, a small amount of Cu may be included while such inclusion is contrary to the definition of a lean alloy (reduction of the content of alloying elements) and low costs. In the case where Cu is included, the lower limit of the content of Cu is set to 0.01%. Thereby, it becomes easier to surpass the corrosion resistance of SUS436L after heating. In addition, since it is necessary to maintain the content of Cu at a requisite minimum level in a range in which workability does not deteriorate, the upper limit of the content of Cu is set to 0.35%. The content of Cu is preferably in a range of 0.10% to 0.30%.

An ordinary stainless steel sheet for components in exhaust systems is manufactured by the following method. Firstly, a steel is melted and refined in a converter or an electric furnace so as to manufacture a slab (bloom, billet). Next, the slab is subjected to hot rolling, pickling, cold rolling, annealing, finishing pickling, and the like so as to manufacture a steel sheet. In addition, an ordinary stainless steel pipe for components in exhaust systems is manufactured by subjecting the above-described steel sheet as a material to electric resistance welding, TIG welding, laser welding, or the like.

The ferritic stainless steel having the above-described composition is manufactured into steel sheets by an ordinary method of manufacturing a stainless steel sheet for components in exhaust systems. In addition, the ferritic stainless steel having the above-described composition is manufactured into welded pipes by an ordinary method of manufacturing a stainless steel pipe for components in exhaust systems.

The ferritic stainless steel sheet manufactured in the above manner is preferably better than SUS436J1L in terms of the workability, and the total elongation is preferably 30.7% or more. The total elongation is measured through the tensile test defined in JISZ2201. With regard to the stainless steel sheet having the components of the embodiment that is manufactured using an ordinary method, it is possible to attain a total elongation in a favorable range.

The corrosion resistance after heating which is defined in the embodiment is evaluated using the maximum corrosion depth that is measured by the following method. Firstly, a corrosion test specimen of a planar sheet is positioned in air atmosphere at 400° C. for 8 hours. Next, the heat-treated corrosion test specimen is subjected to a combined cycle corrosion test and a condensed water corrosion test so as to measure the maximum corrosion depth.

The combined cycle corrosion test is carried out according to JASO-M609-91. Then, the maximum corrosion depth of the test specimen after the corrosion test is measured. The condensed water corrosion test is carried out based on JASO-M611-92-A except that the concentration of Cl ions in a corrosion liquid is set to 1000 ppm. Then, the maximum corrosion depth of the test specimen after the corrosion test is measured. The obtained results of the maximum corrosion depth are compared to the maximum corrosion depths of SUS436L which is a comparison standard so as to evaluate relative merits.

The reason why the heating treatment is carried out on the corrosion test specimen in air atmosphere before the corrosion test is that it is necessary to incorporate conditions which components in an exhaust system in an actual vehicle encounter (that is, conditions in which an oxide film is formed due to the high temperature of the exhaust gas). This oxide film has an influence on the concentration of Cr in the interface between the film and the base metal, and the oxide film acts so as to shield the environmental substances. Therefore, in the case where the heat treatment that forms the oxide film is not carried out, the corrosion characteristics of components in an exhaust system of an actual vehicle cannot be simulated, and valid evaluation is not possible. Sn and Ni that are included in the embodiment not only improve the corrosion resistance of the base metal, but also have influences on the growth behavior, densification, and the like of the oxide film. Therefore, Sn and Ni contribute to the effect of shielding the corrosion substances of the oxide film. As a result, it is assumed that Sn and Ni exhibit an action of improving the corrosion resistance after heating.

Meanwhile, the reason why the concentration of Cl ions is set to 1000 ppm in the condensed water corrosion test will be shown below. In the case where the concentration of Cl ions is 100 ppm as described in JASO standards, a SUS436L-class stainless steel rarely corrodes, and there are cases in which the evaluation results diverge from the corrosion problems (actual corrosion examples) of an actual vehicle (there are cases in which no correlation is observed between the evaluation results and the actual corrosion examples of an actual vehicle). Therefore, in order to set stricter conditions based on the actual corrosion examples occurring in an actual vehicle, the concentration of Cl ions is set to 1000 ppm.

EXAMPLES

Based on the examples, the embodiment will be described in more detail.

150 kg of steels having the compositions as shown in Tables 1 and 2 were melted in a vacuum melting furnace, and the steels were cast so as to produce 50 kg of ingots. Next, the ingots were subjected to processes of hot rolling—annealing of hot-rolled sheets—pickling—cold rolling—annealing—finishing pickling so as to manufacture steel sheets having a thickness of 1.2 mm.

In the process of manufacturing the hot-rolled sheets, ingots having a material thickness of 90 mm were subjected to 9 passes of hot rolling at a heating temperature of 1160° C. so as to obtain a sheet thickness of 3.2 mm. Then, the sheets were subjected to water-cooling. In the process of annealing the hot-rolled sheet, the hot-rolled sheets were subjected to air-cooling at 940° C. for 3 minutes. In the process of manufacturing the cold-rolled sheets, the hot-rolled sheets having a sheet thickness of 3.2 mm were subjected to cold rolling so as to obtain a finished thickness of 1.0 mm. In the annealing process, the cold-rolled sheets were subjected to air-cooling at 920° C. for 1 minute. In the process of pickling the hot-rolled sheets, the hot-rolled sheets were subjected to shot blasting, and then the hot-rolled sheets were pickled using an aqueous solution of sulfuric acid. In the process of finishing pickling, pickling was carried out using an aqueous solution of nitric hydrofluoric acid (a liquid mixture of nitric acid and hydrofluoric acid).

In Tables 1 and 2, the values of components outside the ranges defined in the embodiment are underlined. In addition, a remainder other than the elements described in Tables 1 and 2 is iron and inevitable impurities.

Corrosion test specimens were taken from each of the steel sheets, and test faces were polished using Emery paper 600 grit. Next, the corrosion test specimens were subjected to a heating treatment in a furnace of air atmosphere at a temperature of 400° C. for 8 hours. The heat-treated corrosion test specimens were subjected to a cycle corrosion test and a condensed water corrosion test. In the cycle corrosion test, spraying of salt water, drying, and moistening were repeatedly carried out according to JASO-M609-91 which simulated a salt environment. During the spraying of salt water, a solution of 5% NaCl was sprayed to the specimens at a temperature of 35° C. for 2 hours. During the drying, the specimens were left to stand in an atmosphere having a relative humidity of 20% at a temperature of 60° C. for 4 hours. During the moistening, the specimen was left to stand in an atmosphere having a relative humidity of 90% at 50° C. for 2 hours. The condensed water corrosion test was carried out based on JASO-M611-92-A except that the concentration of Cl ions in the test liquid was set to 1000 ppm.

The corrosion test specimens after completion of the corrosion tests were subjected to a derusting treatment, and then, the maximum corrosion depth was measured by a microscope focal depth method.

In addition, in parallel with the corrosion tests, in order to evaluate the workability, a No. 13B test specimen in JIS Z2201 was manufactured from each of the steel sheets, and a tensile test was carried out. Then, the total elongation of the test specimen in the sheet length direction was evaluated.

In the case where the ratio of the maximum corrosion depth to the maximum corrosion depth of SUS436L (the maximum corrosion depth of the steel sheet specimen/the maximum corrosion depth of SUS436L) was less than 1, the corrosion resistance was evaluated to be good. In addition, in the case where the value of the total elongation was not less than the value (30.7%) of the total elongation of SUS436L, the workability was evaluated to be good.

The test results are shown in Table 3.

TABLE 1

| | | Chemical components (mass %) | | | | | | | | | | | | | |
|---|---|---|---|---|---|---|---|---|---|---|---|---|---|---|---|
| Type | No. | C | Si | Mn | P | S | Al | Cr | Ni | Sn | Ti | Nb | N | Others | Note |
| Example | 1 | 0.0031 | 0.45 | 0.15 | 0.017 | 0.0008 | 0.019 | 17.11 | 0.51 | 0.14 | 0.211 | — | 0.0062 | — | |
| | 2 | 0.0042 | 0.15 | 0.21 | 0.018 | 0.0011 | 0.051 | 17.01 | 0.71 | 0.14 | 0.038 | 0.151 | 0.0071 | — | |
| | 3 | 0.0035 | 0.10 | 0.08 | 0.019 | 0.0009 | 0.049 | 17.03 | 1.01 | 0.14 | 0.198 | — | 0.0068 | — | |
| | 4 | 0.0028 | 0.11 | 0.09 | 0.018 | 0.0091 | 0.052 | 16.99 | 1.20 | 0.14 | 0.201 | — | 0.0073 | — | |
| | 5 | 0.0025 | 0.04 | 0.08 | 0.016 | 0.0021 | 0.048 | 17.02 | 1.50 | 0.14 | 0.205 | — | 0.0059 | — | |
| | 6 | 0.0032 | 0.15 | 0.09 | 0.022 | 0.0012 | 0.051 | 17.01 | 1.80 | 0.02 | 0.202 | — | 0.0069 | — | |
| | 7 | 0.0029 | 0.08 | 0.45 | 0.019 | 0.0010 | 0.069 | 17.12 | 0.61 | 0.10 | 0.189 | — | 0.0060 | — | |
| | 8 | 0.0031 | 0.15 | 0.09 | 0.041 | 0.0011 | 0.044 | 17.08 | 0.61 | 0.20 | 0.195 | — | 0.0079 | — | |
| | 9 | 0.0035 | 0.16 | 0.10 | 0.019 | 0.0010 | 0.051 | 17.03 | 0.61 | 0.30 | — | 0.184 | 0.0055 | — | |
| | 10 | 0.0033 | 0.15 | 0.09 | 0.018 | 0.0011 | 0.059 | 17.10 | 0.61 | 0.48 | 0.223 | — | 0.0074 | — | |
| | 11 | 0.0031 | 0.35 | 0.48 | 0.021 | 0.0012 | 0.098 | 16.59 | 0.51 | 0.06 | 0.287 | — | 0.0071 | — | |
| | 12 | 0.0025 | 0.09 | 0.10 | 0.020 | 0.0010 | 0.021 | 22.35 | 0.51 | 0.02 | 0.221 | — | 0.0069 | — | |
| | 13 | 0.0037 | 0.15 | 0.12 | 0.018 | 0.0011 | 0.051 | 16.98 | 0.61 | 0.10 | 0.211 | — | 0.0057 | Cu: 0.15 | |
| | 14 | 0.0036 | 0.15 | 0.15 | 0.019 | 0.0009 | 0.053 | 16.95 | 0.60 | 0.10 | 0.207 | — | 0.0056 | Mo: 0.15 | |
| | 15 | 0.0031 | 0.07 | 0.08 | 0.018 | 0.0011 | 0.091 | 16.99 | 0.61 | 0.10 | 0.191 | — | 0.0051 | B: 0.0006 | |
| | 16 | 0.0034 | 0.15 | 0.11 | 0.021 | 0.0012 | 0.052 | 16.97 | 1.51 | 0.48 | 0.193 | — | 0.0053 | — | |
| | 17 | 0.0032 | 0.08 | 0.10 | 0.019 | 0.0009 | 0.059 | 18.57 | 1.02 | 0.11 | 0.205 | — | 0.0057 | | |

TABLE 2

| Type | No. | Chemical components (mass %) | | | | | | | | | | | | | |
|---|---|---|---|---|---|---|---|---|---|---|---|---|---|---|---|
| | | C | Si | Mn | P | S | Al | Cr | Ni | Sn | Ti | Nb | N | Others | Note |
| Comparative Example | 101 | 0.0028 | 0.10 | 0.09 | 0.021 | 0.0011 | 0.069 | 17.15 | 0.00 | 0.00 | 0.211 | — | 0.0067 | Mo:1.19 | SUS436L |
| | 102 | 0.0029 | 0.15 | 0.15 | 0.020 | 0.0009 | 0.061 | 16.15 | 0.51 | 0.11 | 0.190 | — | 0.0069 | — | |
| | 103 | 0.0025 | 0.09 | 0.09 | 0.021 | 0.0012 | 0.061 | 19.51 | 0.25 | 0.31 | 0.174 | — | 0.0073 | — | |
| | 104 | 0.0022 | 0.09 | 0.10 | 0.019 | 0.0016 | 0.055 | 17.08 | 0.25 | 0.30 | 0.161 | — | 0.0059 | — | |
| | 105 | 0.0042 | 0.11 | 0.09 | 0.018 | 0.0011 | 0.051 | 17.11 | 0.00 | 0.30 | 0.221 | — | 0.0069 | — | |
| | 106 | 0.0035 | 0.15 | 0.10 | 0.018 | 0.0021 | 0.052 | 17.01 | 0.00 | 0.20 | 0.211 | — | 0.0060 | — | |
| | 107 | 0.0028 | 0.13 | 0.11 | 0.018 | 0.0012 | 0.048 | 17.03 | 0.00 | 0.10 | 0.207 | — | 0.0079 | — | |
| | 108 | 0.0025 | 0.15 | 0.09 | 0.018 | 0.0010 | 0.051 | 16.99 | 0.00 | 0.14 | 0.191 | — | 0.0055 | — | |
| | 109 | 0.0032 | 0.16 | 0.08 | 0.018 | 0.0011 | 0.069 | 17.02 | 0.30 | 0.14 | 0.198 | — | 0.0074 | — | |
| | 110 | 0.0029 | 0.15 | 0.09 | 0.018 | 0.0011 | 0.044 | 17.01 | 0.51 | 0.00 | 0.201 | — | 0.0071 | — | |
| | 111 | 0.0031 | 0.13 | 0.11 | 0.018 | 0.0021 | 0.052 | 16.99 | 0.71 | 0.00 | 0.205 | — | 0.0069 | — | |
| | 112 | 0.0035 | 0.14 | 0.12 | 0.018 | 0.0012 | 0.048 | 17.01 | 0.98 | 0.00 | 0.202 | — | 0.0057 | — | |
| | 113 | 0.0033 | 0.15 | 0.17 | 0.018 | 0.0010 | 0.051 | 17.03 | 0.31 | 0.00 | 0.189 | — | 0.0056 | — | |
| | 114 | 0.0031 | 0.09 | 0.15 | 0.018 | 0.0011 | 0.069 | 16.99 | 0.11 | 0.00 | 0.211 | — | 0.0067 | — | |
| | 115 | 0.0025 | 0.15 | 0.14 | 0.018 | 0.0018 | 0.044 | 17.02 | 0.52 | 0.54 | 0.209 | — | 0.0069 | — | |
| | 116 | 0.0037 | 0.21 | 0.16 | 0.018 | 0.0013 | 0.051 | 17.01 | 2.12 | 0.30 | 0.191 | — | 0.0073 | — | |
| | 117 | 0.0036 | 0.19 | 0.17 | 0.018 | 0.0018 | 0.059 | 17.12 | 2.15 | 0.48 | 0.188 | — | — | — | |

TABLE 3

| Type | No. | Maximum corrosion depth (μm) | | Ratio of the maximum corrosion depth to the maximum corrosion depth of SUS436L | | Workability | |
|---|---|---|---|---|---|---|---|
| | | Salt corrosion | Condensed water corrosion | Salt corrosion | Condensed water corrosion | Elongation (%) | Note |
| Example | 1 | 220 | 140 | 0.96 | 0.97 | 32.1 | |
| | 2 | 180 | 110 | 0.78 | 0.76 | 32.0 | |
| | 3 | 160 | 80 | 0.70 | 0.55 | 31.9 | |
| | 4 | 150 | 60 | 0.65 | 0.41 | 31.4 | |
| | 5 | 136 | 40 | 0.59 | 0.28 | 30.8 | |
| | 6 | 115 | 25 | 0.50 | 0.17 | 30.7 | |
| | 7 | 228 | 140 | 0.99 | 0.97 | 31.9 | |
| | 8 | 132 | 90 | 0.57 | 0.62 | 31.7 | |
| | 9 | 80 | 45 | 0.35 | 0.31 | 31.5 | |
| | 10 | 60 | 25 | 0.26 | 0.17 | 30.8 | |
| | 11 | 180 | 98 | 0.78 | 0.68 | 33.9 | |
| | 12 | 120 | 25 | 0.52 | 0.17 | 30.9 | |
| | 13 | 204 | 128 | 0.89 | 0.88 | 31.7 | |
| | 14 | 210 | 128 | 0.91 | 0.88 | 31.7 | |
| | 15 | 226 | 138 | 0.98 | 0.95 | 32.0 | |
| | 16 | 117 | 26 | 0.51 | 0.18 | 30.7 | |
| | 17 | 135 | 51 | 0.59 | 0.35 | 31.0 | |
| Comparative Example | 101 | 230 | 145 | 1.00 | 1.00 | 30.7 | SUS436L |
| | 102 | 620 | 280 | 2.70 | 1.93 | 32.1 | |
| | 103 | 365 | 180 | 1.59 | 1.24 | 32.5 | |
| | 104 | 407 | 166 | 1.77 | 1.14 | 33.0 | |
| | 105 | 490 | 185 | 2.13 | 1.28 | 33.4 | |
| | 106 | 590 | 260 | 2.57 | 1.79 | 33.9 | |
| | 107 | 700 | 330 | 3.04 | 2.28 | 34.4 | |
| | 108 | 751 | 316 | 3.27 | 2.18 | 33.7 | |
| | 109 | 650 | 290 | 2.83 | 2.00 | 33.1 | |
| | 110 | 551 | 300 | 2.40 | 2.07 | 33.3 | |
| | 111 | 450 | 260 | 1.96 | 1.79 | 32.6 | |
| | 112 | 380 | 220 | 1.65 | 1.52 | 31.9 | |
| | 113 | 670 | 340 | 2.91 | 2.34 | 34.1 | |
| | 114 | 770 | 390 | 3.35 | 2.69 | 34.3 | |
| | 115 | 179 | 85 | 0.78 | 0.59 | 28.9 | |
| | 116 | 90 | 22 | 0.39 | 0.15 | 15.1 | |
| | 117 | 88 | 20 | 0.38 | 0.14 | 12.1 | |

In the embodiment, the object is to improve the corrosion resistance after heating so as to be not less than that of SUS436L. Therefore, in Table 3, the ratio of the maximum corrosion depth of the steel sheet specimen to the maximum corrosion depth of SUS436L (the maximum corrosion depth of the steel sheet specimen/the maximum corrosion depth of SUS436L) is shown.

Meanwhile, Comparative Example No. 101 is SUS436L.

Since Comparative Example No. 102 has a small content of Cr, sufficient corrosion resistance could not be obtained. In Comparative Examples No. 103 to 109, the contents of Ni were outside the range defined in the embodiment. In Comparative Examples No. 110 to 112, the contents of Sn were outside the range defined in the embodiment. In Comparative Examples No. 113 to 114, the contents of Sn and Ni were outside the range defined in the embodiment. Therefore, with regard to Comparative Examples No. 103 to 114, the corrosion resistance after heating was insufficient. With regard to Comparative Examples No. 115 to 117, since the contents of Sn or Ni were too large, the elongation values were lower than the value of SUS436L; and therefore, the workability was insufficient.

On the other hand, in Examples No. 1 to 17, the contents of the alloying elements were appropriate, and both of the corrosion resistance after heating and the workability were sufficiently satisfactory values that were not less than those of SUS436L.

INDUSTRIAL APPLICABILITY

The ferritic stainless steel according to the aspect of the invention contains no Mo or a reduced amount of Mo, and has corrosion resistance and workability which are similar to or superior to those of SUS436L. Therefore, the ferritic stainless steel according to the aspect of the invention can be preferably applied as a material for use in components in an automobile exhaust system such as center pipes, mufflers, tail pipes, and the like.

The invention claimed is:

1. A ferritic stainless steel for components of an automobile exhaust system, the ferritic stainless steel consisting of, in terms of percent by mass:

C: ≤0.015%;
Si: 0.01% to 0.50%;
Mn: 0.01% to 0.50%;
P: ≤0.050%;
S: ≤0.010%;
N: ≤0.015%;
Al: 0.010% to 0.100%;
Cr: 16.5% to 22.5%;
Ni: 0.51% to 2.0%;
Sn: 0.01% to 0.50%;
Mo: 0.01% to 0.2%;
either one or both of Ti: 0.03% to 0.30% and Nb: 0.03% to 0.30%; and
a remainder of Fe and inevitable impurities;
wherein:
a total elongation measured through a tensile test defined in JISZ2201 is 30.7% or more;
a ratio of a maximum corrosion depth of the ferritic stainless steel to a maximum corrosion depth of SUS436L is less than 1 in each of the following cases:
(a) where the maximum corrosion depth is measured by a method including:
(i) taking a test specimen from the ferritic stainless steel;
(ii) subjecting the test specimen to a heating treatment in air atmosphere at a temperature of 400° C. for 8 hours;
(iii) subjecting the heat-treated test specimen to a cycle corrosion test according to JASO-M609-91; and
(iv) measuring the maximum corrosion depth; and
(b) where the maximum corrosion depth is measured by a method including:
(i) the taking of the test specimen from the ferritic stainless steel;
(ii) the subjecting of the test specimen to the heating treatment in air atmosphere at the temperature of 400° C. for 8 hours;
(iii) subjecting the heat-treated test specimen to a condensed water corrosion test based on JASO-M611-92-A except that a concentration of Cl ions in a test liquid is set to 1000 ppm; and
(iv) the measuring of the maximum corrosion depth.

2. A ferritic stainless steel for components of an automobile exhaust system, the ferritic stainless steel consisting of, in terms of percent by mass:

C: ≤0.015%;
Si: 0.01% to 0.50%;
Mn: 0.01% to 0.50%;
P: ≤0.050%;
S: ≤0.010%;
N: ≤0.015%;
Al: 0.010% to 0.100%;
Cr: 16.5% to 22.5%;
Ni: 0.51% to 2.0%;
Sn: 0.01% to 0.50%;
Mo: 0.01% to 0.2%;
either one or both of Ti: 0.03% to 0.30% and Nb: 0.03% to 0.30%;
either one or both of B: 0.0002% to 0.0050% and Cu: 0.01% to 0.35%; and
a remainder of Fe and inevitable impurities;
wherein:
a total elongation measured through a tensile test defined in JISZ2201 is 30.7% or more;
a ratio of a maximum corrosion depth of the ferritic stainless steel to a maximum corrosion depth of SUS436L is less than 1 in each of the following cases:
(a) where the maximum corrosion depth is measured by a method including:
(i) taking a test specimen from the ferritic stainless steel;
(ii) subjecting the test specimen to a heating treatment in air atmosphere at a temperature of 400° C. for 8 hours;
(iii) subjecting the heat-treated test specimen to a cycle corrosion test according to JASO-M609-91; and
(iv) measuring the maximum corrosion depth; and
(b) where the maximum corrosion depth is measured by a method including:
(i) the taking of the test specimen from the ferritic stainless steel;
(ii) the subjecting of the test specimen to the heating treatment in air atmosphere at the temperature of 400° C. for 8 hours;
(iii) subjecting the heat-treated test specimen to a condensed water corrosion test based on JASO-M611-92-A except that a concentration of Cl ions in a test liquid is set to 1000 ppm; and
(iv) the measuring of the maximum corrosion depth.

* * * * *